United States Patent [19]

Harvey

[11] 4,372,468

[45] Feb. 8, 1983

[54] TOOL HOLDER

[75] Inventor: Robert P. Harvey, Northridge, Calif.

[73] Assignee: McGuire-Nicholas Manufacturing Company, Los Angeles, Calif.

[21] Appl. No.: 261,911

[22] Filed: May 8, 1981

[51] Int. Cl.[3] ..... A45F 5/00

[52] U.S. Cl. ..... 224/268; 224/253; 224/904; 211/60 T

[58] Field of Search ..... 224/253, 200, 232, 242, 224/247, 268, 904; 211/60 G, 60 M, 60 T, 62, 63, 65, 66, 68, 70

[56] References Cited

U.S. PATENT DOCUMENTS

| | | | |
|---|---|---|---|
| 2,618,419 | 11/1952 | Vanish | 211/60 T X |
| 2,985,349 | 5/1961 | McGuire | 224/268 |
| 3,095,092 | 6/1963 | Magarian | 211/60 T |
| 3,156,388 | 11/1964 | Simmons | 224/904 X |
| 3,212,688 | 10/1965 | Lane | 224/904 X |
| 3,599,847 | 8/1971 | Danielson | 224/904 X |

*Primary Examiner*—Steven M. Pollard

*Attorney, Agent, or Firm*—Lyon & Lyon

[57] ABSTRACT

Disclosed herein is a snap-lock device for securing and pivotally supporting a hammer or other similar tool from the user's waist belt. The device is comprised of a pad support which is suspended from the waist belt, an open ended tool support which is pivotally mounted on the pad for carrying the tool and a pair of spring biased tool retention gates which are mounted on the open ends of the tool support loop for rapid lateral entry of the tool into the tool support loop and securement of the tool therein.

6 Claims, 4 Drawing Figures

FIG. 1
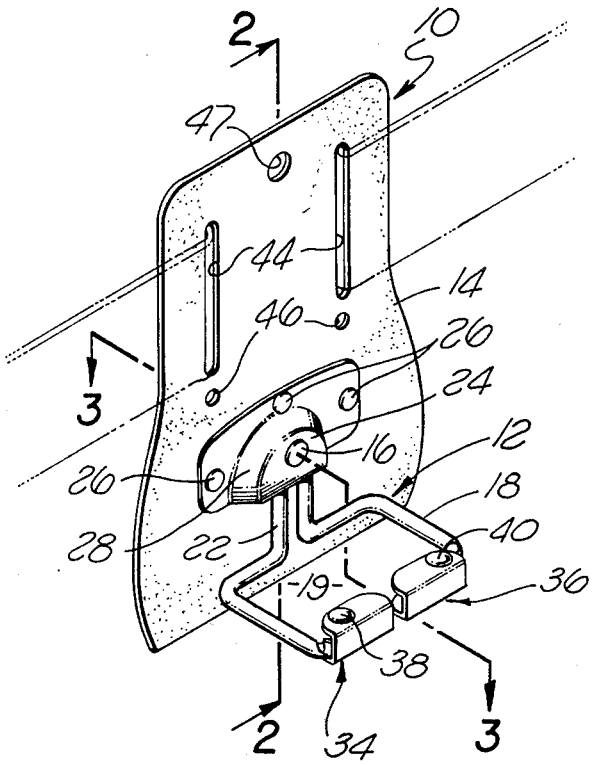
FIG. 2
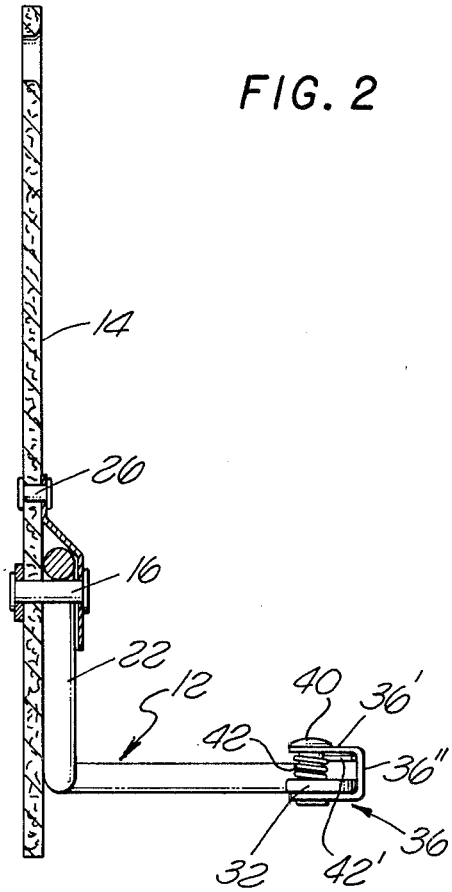
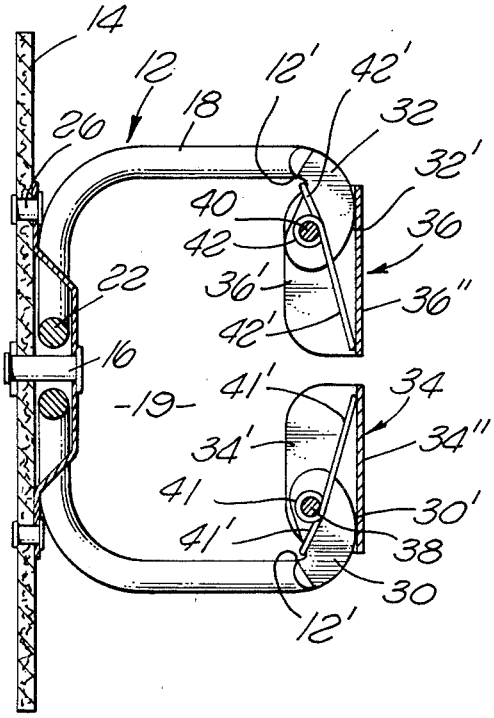
FIG. 3
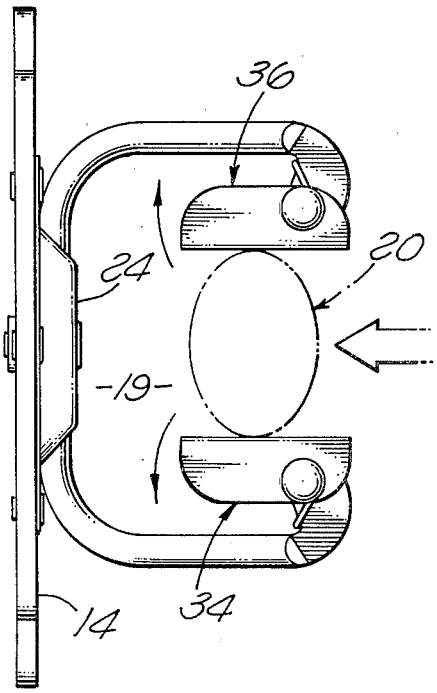
FIG. 4

TOOL HOLDER

BACKGROUND OF THE INVENTION

Devices for more conveniently carrying one's tools on one's person are continually being sought after by both carpenters and handymen alike. Tools like hammers and hatchets which have elongated handles and transversely mounted head pieces have always presented problems because of their particular handle and head configurations. Carrying devices for hammers and hatchets have ranged from simple loops in one's work pants for the insertion of the elongated handle therethrough to specially designed leather holsters in which the head of the tool is secured. For comfort and convenience, various devices have been developed which provide for a pivotal mounting of the tool on the user's waist. An example of such a device is found in U.S. Pat. No. 4,106,679 wherein is taught the use of a horizontally disposed closed tool carrying loop which is pivotally mounted on a pad suspended from the wearer's waistband. While such a device may reduce the wear and tear on the user's pants which has heretofore resulted from the use of cloth loops sewn thereon, and is somewhat more convenient than belt mounted holsters in that it allows the tool to pivot with respect to the waistband as the user moves about in his work, it does not provide the user with any means of readily securing the tool within the carrying device without having to devote some degree of attention to the task. This diversion of attention can often be interruptive and reduce one's efficiency in carrying out the task at hand.

It would be highly desirable if one could develop a device which not only provided the convenience of pivotally securing the elongated tool at the wearer's waistband but also facilitated the securement of the tool within the device in such a manner as to minimize the diversion of attention required for the task. With such a device, the user would not only have a convenient means for carrying the tool on his person but would be provided with a device so convenient in its use that his hammer or hatchet would always be at his side when needed. Such a device is disclosed herein.

SUMMARY OF THE INVENTION

Briefly, the present invention is directed to a tool carrying device adapted to be suspended from the user's waist for pivotally supporting a hammer-like tool thereon which provides a simple snap-lock securement of the tool to the carrying device.

It is the principal object of the present invention to provide an improved tool carrier for hammers, hatchets and/or tools of similar overall configuration.

It is another object of the present invention to provide a device for carrying hammer-like tools which allows for simple lateral entry of the tool into the device and securement of the tool therein.

It is yet another object of the present invention to provide a device for carrying hammer-like tools from the user's waist which allows for simple lateral securement of the tool to the device and pivotal movement of the tool with respect to the waist of the user while preventing accidental dislodgement of the tool from the device.

It is a still further object of the present invention to provide a device for carrying hammer-like tools which is of simple construction and easy to manufacture.

These and other objects and advantages of the present invention will become apparent from the detailed description taken in conjunction with the accompanying drawings.

IN THE DRAWINGS

FIG. 1 is a perspective view of the tool holder of the present invention.

FIG. 2 is a sectional view taken along lines 2—2 in FIG. 1.

FIG. 3 is an enlarged sectional view taken along lines 3—3 in FIG. 1.

FIG. 4 is a top view of the tool holder illustrating the insertion of the tool into the holder.

DESCRIPTION OF THE PREFERRED EMBODIMENT

Referring now in detail to the drawings, the tool holder 10 of the present invention is comprised of a tool support loop 12 which, in the embodiment shown, is pivotally mounted on a pad 14 of pliant material such as leather, by means of a pin 16. The tool support loop 12 defines a main horizontally disposed loop portion 18 circumscribing an area 19 for carrying a tool 20 such as a hammer, hatchet or other tool of similar configuration having an elongated handle and transverse head portion, and a secondary vertical loop portion 22 through which pin 16 extends to pivotally secure the support loop 12 to the pad 14. A cover member 24 is provided which is secured to pad 14 by rivets 26 and which defines a curvilinear stop wall 28 to limit the rotational movement of the support loop 22 to around 60°. This limiting angle is not critical, however, and serves solely to prevent the tool from pivoting to a disposition from which it could fall from the tool support loop.

The tool support loop 12 terminates in extended end portions 30 and 32 which project inwardly across open area 19 parallel to the pad 14. Ends 30 and 32 are provided with tool retention gates 34 and 36 which are pivotally secured to ends 30 and 32 by pins 38 and 40 respectively. Each gate is substantially "U"-shaped in cross-section defining leg portions 34' and 36' and connection bar portions 34'' and 36''. Pins 38 and 40 extend through the ends 30 and 32 of the tool support loop 12 and leg portions 34' and 36' respectively to effect the pivotal securement of the gates to the tool support loop. The loop ends 30 and 32 are substantially flat in contrast to the circular cross-section of the remainder of the tool support loop to facilitate the placement of the gate mounting pins therethrough.

The outermost edges 30' and 32' of the flat open end portions of the tool support loop cooperate with the interior side of gate bar portions 34'' and 36'' to restrict the outward pivotal movement of the tool retention gates to the closed position wherein they extend substantially parallel to the plane of pad 14. At that point, the interior sides of the gates about these outermost edges of the tool loop ends and thereby prevent any further outward rotational movement of the gates. By limiting the pivotal movement of the gates to the inward direction, the tool carried by the support loop cannot be pulled laterally through the gates if it were to become accidentally caught on something.

Coil spring members 41 and 42 are disposed about pins 38 and 40 for biasing the gates 34 and 36 to the closed position. Each spring defines a first extension 40' and 42' at one end thereof which abuts and presses against the interior sides of the gate bar portions 34'' and 36″ respectively and second extensions 40″ and 42″ which are bent at approximately right angles near the ends thereof and abut and press against the side wall portions 12′ of the tool support loop 12 adjacent the flattened end portions 30 and 32 thereof. It is to be understood that other spring configurations could be employed to bias the retention gates to their closed positions. So biased, the gates 34 and 36 allow the tool to be snapped into securement within the area 19 circumscribed by the tool support loop and secured therein against outward lateral forces. The tool is supported by its head portion resting on the support loop 12 and can undergo pivotal movement with the support loop for the comfort and convenience of the user.

The pad 14 to which the tool support loop is pivotally mounted is provided with slots 44 for securement of the pad to the user's waist belt. Apertures 46 can be provided below the slots 44 to facilitate extension of the slots to accommodate wider belts and a central upper aperture 47 can be provided in the pad to hang the tool carrying device from a nail or hook near a workbench. This configuration of pad 14, however, is merely illustrative of a support element to which the gated tool support loop could be pivotally secured to provide an easy access yet secure carrying device for hammer-like configured tools.

Various changes and modifications may be made in carrying out the present invention without departing from the spirit and scope thereof. Insofar as these changes and modifications are within the purview of the appended claims, they are to be considered as part of the present invention.

I claim:

1. A tool carrying device for supporting an implement of the type having an elongated handle and transverse head portion, said device comprising: a support backing; a tool support loop defining two extended open ends and being pivotally mounted on said backing such that said loop extends substantially perpendicularly with respect to said backing; a pair of gate members, one of said members being pivotally mounted on each of said open ends of said tool support loop; and means for biasing certain gate members to a position substantially parallel with said backing.

2. The combination of claim 1 wherein said open ends of said tool support loop extend substantially parallel to said backing and said biasing means comprise springs extending between each of said gate members and the extended ends of said tool support loop.

3. The combination of claim 2 including means for preventing pivotal movement of said gate members in a direction outwardly from said backing.

4. A tool carrying device for supporting an implement of the type having an elongated handle and transverse head portion from the waist of the user, said device comprising: a support backing adapted to be supported from the waist of the user; a tool support loop partially circumscribing a tool receiving area and defining two open ends; means for pivotally mounting said loop on said backing such that said loop extends substantially perpendicularly from said backing; a pair of gate members; means for pivotally mounting one of said gate members on each of said extended ends of said tool support loop; spring means extending between said gate members and said extended ends of said tool support loop for biasing said gate members to a position substantially parallel with said backing; and means for preventing movement of said gate member in a direction outwardly of said tool receiving area.

5. The combination of claim 4 wherein said gate members are substantially "U"-shaped in cross-section defining bar and leg portions, said portions being disposed about said extended ends of said tool support loop, the interior side of said bar portions abutting said extended ends to prevent pivotal movement of said gate members in a direction outwardly of said tool receiving area.

6. The combination of claim 5 wherein said gate mounting means comprise pins extending through the leg portions of said gate members and the extended ends of said tool support loop and wherein said spring members are carried by said pins and extended between the bar portions of said gate members and said extended ends of said tool support loop.

* * * * *